US008492965B2

(12) United States Patent
Kato

(10) Patent No.: US 8,492,965 B2
(45) Date of Patent: Jul. 23, 2013

(54) SPARK PLUG WITH ENHANCED BREAKAGE RESISTANCE FOR THE GROUND ELECTRODE

(75) Inventor: Shoichi Kato, Tajima (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/479,214

(22) Filed: May 23, 2012

(65) Prior Publication Data

US 2012/0299460 A1 Nov. 29, 2012

(30) Foreign Application Priority Data

May 27, 2011 (JP) ..... 2011-119423
Mar. 29, 2012 (JP) ..... 2012-77692

(51) Int. Cl.
*H01T 13/20* (2006.01)

(52) U.S. Cl.
USPC ..... 313/143; 313/141

(58) Field of Classification Search
CPC . H01T 13/20; H01T 13/39; H01T 13/38; F02B 75/36
USPC ..... 313/141, 143–144, 118
See application file for complete search history.

(56) References Cited

U.S. PATENT DOCUMENTS

| | | | |
|---|---|---|---|
| 7,282,845 | B2 | 10/2007 | Hiramatsu |
| 8,207,657 | B2 | 6/2012 | Suzuki et al. |
| 2005/0104495 | A1 | 5/2005 | Hiramatsu |
| 2010/0133977 | A1 | 6/2010 | Kato |
| 2011/0198982 | A1 | 8/2011 | Suzuki et al. |

FOREIGN PATENT DOCUMENTS

| | | | |
|---|---|---|---|
| JP | 2003-007423 | A | 1/2003 |
| JP | 2005-149896 | A | 6/2005 |
| WO | 2009020141 | A1 | 2/2009 |
| WO | 2010053099 | A1 | 5/2010 |

OTHER PUBLICATIONS

Japanese Office Action dated May 14, 2013 for corresponding Japanese Patent Application No. JP 2012-077692.

*Primary Examiner* — Tracie Y Green
(74) *Attorney, Agent, or Firm* — Sughrue Mion, PLLC

(57) ABSTRACT

In a spark plug in which one end of a ground electrode 9 is welded to a front end surface (7*a*) of a tubular metallic shell (7), the following relations (1) and (2) are satisfied:

$$K \geqq 1.1A \quad (1)$$

$$K \geqq (D-d)/2 \quad (2)$$

where A represents the wall thickness of the metallic shell in the radial direction measured on the front end surface at a position where the wall thickness becomes the minimum; d represents the maximum inner diameter of the front end surface; D represents the minimum outer diameter of the front end surface; and K represents the wall thickness in a region of the front end surface where the ground electrode is welded to the front end surface.

2 Claims, 10 Drawing Sheets

7: METALLIC SHELL
7A: FRONT END SURFACE
9: GROUND ELECTRODE
11: INNER CIRCUMFERENTIAL EDGE
13: OUTER CIRCUMFERENTIAL EDGE
S: WELDING REGION

7: METALLIC SHELL

7A: FRONT END SURFACE

9: GROUND ELECTRODE

11: INNER CIRCUMFERENTIAL EDGE

13: OUTER CIRCUMFERENTIAL EDGE

S: WELDING REGION

RELATION BETWEEN THICKNESS RATIO AND NUMBER OF TIMES OF BENDING BEFORE BREAKING

SPARK PLUG WITH ENHANCED BREAKAGE RESISTANCE FOR THE GROUND ELECTRODE

TECHNICAL FIELD

The present invention relates to a spark plug used for igniting fuel gas in an internal combustion engine such as an automotive engine.

BACKGROUND ART

In general, such a spark plug includes a rodlike center electrode; a tubular insulator covering the outer circumference of the center electrode; a tubular metallic shell fitted onto the outer circumference of the insulator; and a ground electrode whose one end is welded to the front end surface of the metallic shell and whose other end is disposed to face the distal end of the center electrode to thereby form a spark discharge gap between the ground electrode and the center electrode.

In such a spark plug, in recent years, the ground electrode (also called "outer electrode" among persons in the spark plug industry) becomes more likely to suffer problems, such as breakage, because of an increase in the output of an internal combustion engine. Conceivable causes of such a problem include resonance and large acceleration (G) caused by the engine or combustion vibration. Also, occurrence of such a problem deeply relates to the structure in which the ground electrode is bent such that its distal end faces the center electrode and a bending moment is therefore apt to act on the proximal end of the ground electrode through which the ground electrode is attached to the metallic shell, and the structure in which the ground electrode is attached to a position where the ground electrode directly receives a shock wave or the like produced as a result of combustion.

In the above-described spark plug, increasing the cross-sectional area of the ground electrode is effective for improving the breakage resistance of the ground electrode. However, in the case where the cross-sectional area of the ground electrode is increased by increasing the width of the ground electrode, the flame-cooling effect of the ground electrode becomes stronger, and the ignition performance of the spark plug deteriorates.

Therefore, the cross-sectional area of the ground electrode is increased by increasing the thickness of the ground electrode. However, if the thickness of the ground electrode is rendered greater than the wall thickness of the metallic shell measured on the front end surface thereof, a portion of the ground electrode in the thickness direction thereof projects from the front end surface of the metallic shell in the radial direction, which may decrease the welding strength of the ground electrode.

In view of the above, in Patent Document 1, there is proposed a technique of rendering the thickness of the ground electrode equal to the wall thickness of the metallic shell measured on the front end surface thereof, and curving the ground electrode such that the cross-sectional shape of the ground electrode coincides with the curved shape of the front end surface of the metallic, to thereby increase the cross-sectional area of the ground electrode without lowering the welding strength, which would otherwise occur due to the projection in the radial direction.

PRIOR ART DOCUMENT

Patent Document

[Patent Document 1] Japanese Patent Application Laid-Open (kokai) No. 2003-7423

SUMMARY OF THE INVENTION

Problems to be Solved by the Invention

However, the front end surface of the metallic shell of the spark plug disclosed in Patent Document 1 has concentric inner and outer circumferential edges which are perfectly round. Therefore, the metallic shell has a uniform wall thickness over the entire circumference thereof. The wall thickness Km of the metallic shell measured on the front end surface thereof is represented by an expression Km=(D−d)/2, where D is the outer diameter of the front end surface of the metallic shell, and d is the inner diameter of the front end surface of the metallic shell.

Accordingly, when the technique disclosed in Patent Document 1 is employed, the thickness tm of the ground electrode is limited to (D−d)/2 (the maximum thickness), and the cross-sectional area cannot be increased greatly.

A conceivable method of increasing the thickness of the ground electrode is rendering the outer diameter D of the front end surface of the metallic shell greater than that of a conventional spark plug or rendering the inner diameter d of the front end surface of the metallic shell smaller than that of the conventional spark plug, to thereby increase the wall thickness of the metallic shell measured on the front end surface thereof. However, in such a case, the area of the front end surface of the metallic shell changes from that in the conventional spark plug, whereby the heat capacity of the metallic shell changes, which affects the heat resistance, etc. of the spark plug. Therefore, difficulty is encountered in putting the method into practice.

In the case where the ground electrode is curved such that the cross-sectional shape of the ground electrode coincides with the curved shape of the front end surface of the metallic shell, as compared with a ground electrode having a simple rectangular cross section, the ground electrode becomes difficult to bend, and the work of bending the ground electrode so as to secure a spark discharge gap becomes difficult.

An object of the present invention is to solve the above-described problems and to provide a spark plug which enables the breakage resistance of its ground electrode to be enhanced by increasing the cross-sectional area of the ground electrode without changing the area of the front end surface of its metallic shell.

Means for Solving the Problems

The above-described object of the present invention is accomplished by the following configurations.

(1) A spark plug including a tubular metallic shell, and a ground electrode welded to a front end surface of the metallic shell, the spark plug being characterized by satisfying the following relations (1) and (2):

$$K \geqq 1.1A \quad (1)$$

$$K \geqq (D-d)/2 \quad (2)$$

where A represents a wall thickness of the metallic shell in the radial direction measured on the front end surface at a position where the wall thickness becomes the minimum; d represents a maximum inner diameter of the front end surface; D represents a minimum outer diameter of the front end surface; and K represents the wall thickness in a region of the front end surface where the ground electrode is welded to the front end surface.

(2) A spark plug having the above-described configuration (1), wherein the front end surface has a circular outer circumferential edge and a circular inner circumferential edge, and an eccentricity of 0.5 mm or greater is present between the center of the outer circumferential edge and the center of the inner circumferential edge.

According to the above-described configuration (1), the ground electrode is welded to the front end surface in a region where the wall thickness K becomes equal to or greater than 1.1A and equal to or greater than (D−d)/2. Accordingly, as compared with a conventional metallic shell in which the inner and outer circumferential edges of the front end surface are concentric perfectly round circles, and the outer and inner diameters of the front end surface are D and d, respectively, the ground electrode can be welded to the front end surface in a region where the metallic shell has an increased wall thickness as compared with the conventional metallic shell despite the area of the front end surface being the same as that of the conventional metallic shell. Thus, the breakage resistance can be enhanced.

According to the structure described in the above-described par. (1), the ground electrode is welded to the front end surface in a region which satisfies two conditions; i.e., $K \geqq 1.1A$ and $K \geqq (D-d)/2$, where A represents the wall thickness measured on the front end surface at a position where the wall thickness becomes the minimum; d represents the maximum inner diameter of the front end surface; D represents the minimum outer diameter of the front end surface; and K represents the wall thickness in a region of the front end surface where the ground electrode is welded to the front end surface. Therefore, the thickness of the ground electrode can be increased as compared with the conventional ground electrode without fail. Accordingly, it is possible to increase the cross-sectional area of the ground electrode by increasing the thickness of the ground electrode, without changing the area of the front end surface of the metallic shell, whereby the breakage resistance of the ground electrode can be enhanced.

Moreover, the wall thickness as measured in the region of the front end surface of the metallic shell in which the ground electrode is welded to the front end surface is rendered greater than that of the conventional metallic shell. Therefore, it is possible to increase the thickness of the ground electrode as compared with the conventional ground electrode, while maintaining the simple rectangular cross section of the ground electrode, without imparting a curved shape to the ground electrode such that the cross-sectional shape of the ground electrode coincides with the curved shape of the front end surface of the metallic shell.

Accordingly, the ground electrode can be formed to have a simple rectangular cross section to thereby facilitate a bending work or the like performed for securing the spark discharge gap.

According to the above-described configuration (2), the maximum wall thickness in the region of the front end surface where the ground electrode is welded thereto can be adjusted by adjusting the amount $\alpha$ of the eccentricity between the outer and inner circumferential edges of the front end surface. When the amount $\alpha$ of the eccentricity is set to 0.5 mm or greater, the wall thickness becomes greater than (D−d)/2 in a circumferential region whose extent is equal to or greater than half the circumference of the front end surface of the metallic shell. Thus, it becomes easy to secure a welding region in which the metallic shell has a wall thickness suitable for welding the ground electrode having a sufficiently large thickness which remarkably enhances the breakage resistance thereof.

Effects of the Present Invention

According to the spark plug of the present invention, as compared with the conventional metallic shell in which the inner and outer circumferential edges of the front end surface thereof are concentric, perfectly round circles, the wall thickness of the metallic shell measured on the front end surface becomes nonuniform. Thus, even when the area of the front end surface is the same as that of the conventional metallic shell, the metallic shell can have a portion where the wall thickness is greater than that of the conventional metallic shell.

According to the spark plug of the present invention, the portion of the metallic shell to which the ground electrode is welded can have a wall thickness greater than that of the conventional metallic shell. Thus, the thickness of the ground electrode can be increased as compared with the conventional ground electrode without fail. Accordingly, it is possible to increase the cross-sectional area of the ground electrode by increasing the thickness of the ground electrode, without changing the area of the front end surface of the metallic shell, whereby the breakage resistance of the ground electrode can be enhanced.

Moreover, according to the spark plug of the present invention, the wall thickness measured in the region of the front end surface of the metallic shell in which the ground electrode is welded to the front end surface is set to be greater than that of the conventional metallic shell. Therefore, it is possible to increase the thickness of the ground electrode, as compared with the conventional spark plug, while maintaining the simple rectangular cross section of the ground electrode, without imparting a curbed shape to the ground electrode such that the cross-sectional shape of the ground electrode coincides with the curved shape of the front end surface of the metallic shell.

Accordingly, the ground electrode can be formed to have a simple rectangular cross section to thereby facilitate a bending work or the like performed for securing the spark discharge gap.

MODE FOR CARRYING OUT THE INVENTION

Preferred embodiments of a spark plug according to the present invention will now be described in detail with reference to the drawings.

Figure 1:
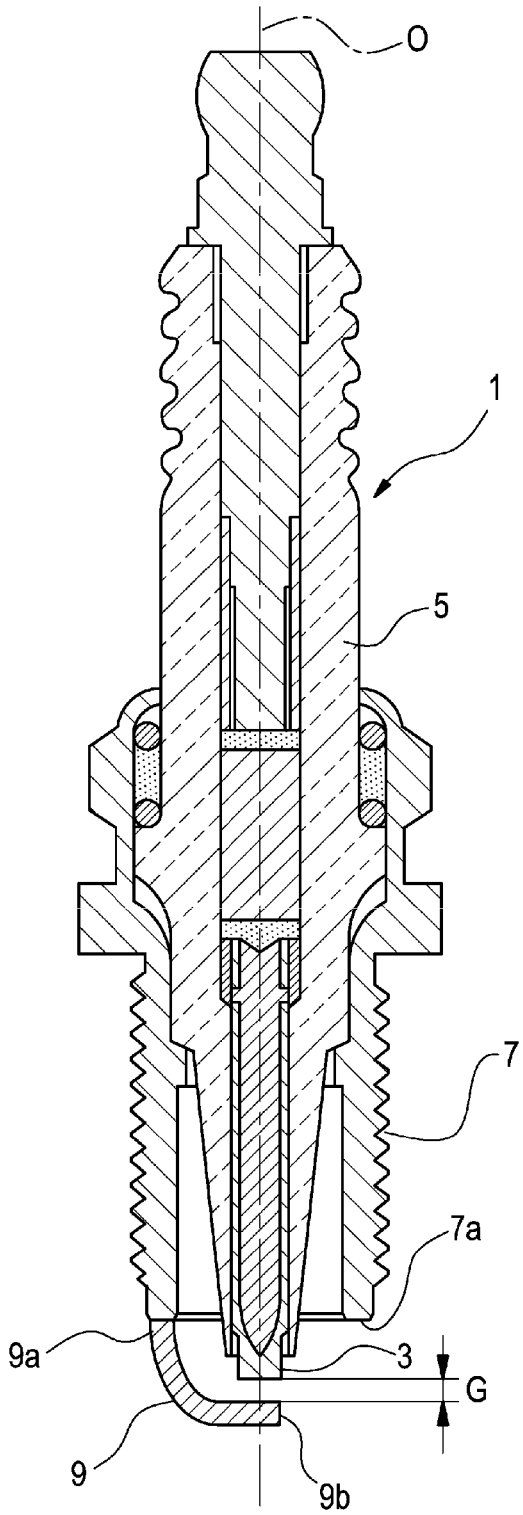
FIG. 1 is a vertical cross-sectional view of a first embodiment of a spark plug according to the present invention.
Figure 2:
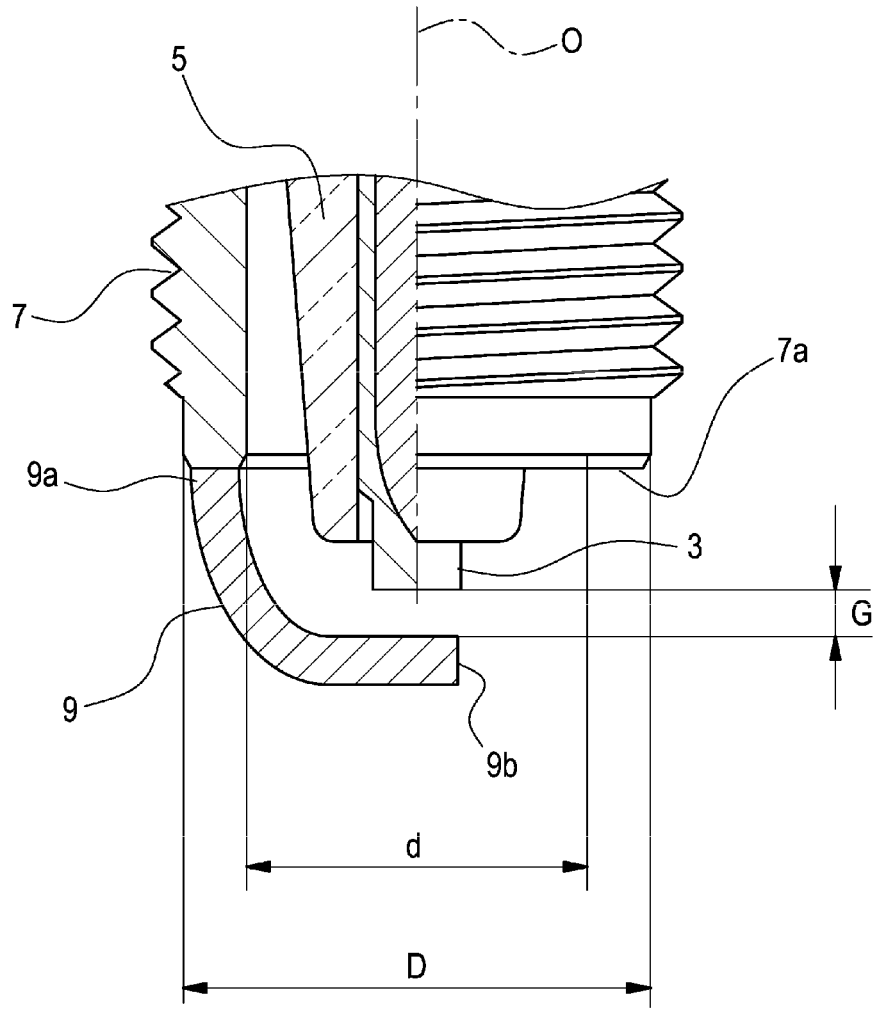
FIG. 2 is an enlarged view of a main portion of FIG. 1.
Figure 3A:
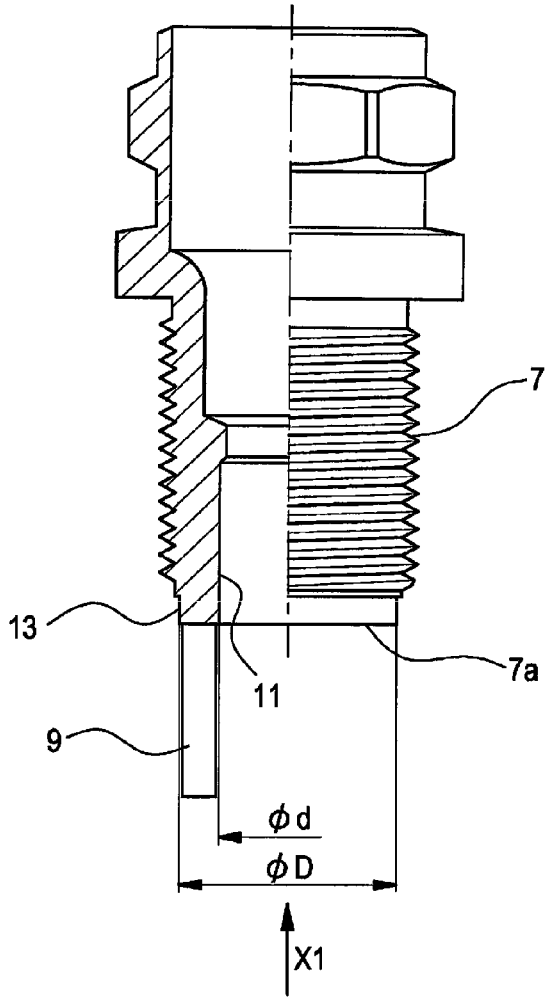
FIG. 3A is a side view of the metallic shell shown in FIG. 1.
Figure 3B:
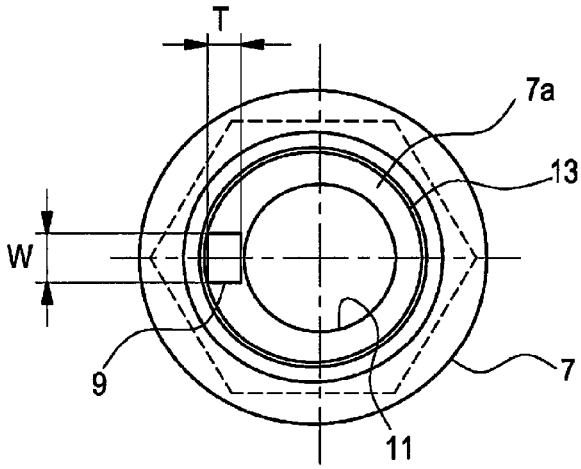
FIG. 3B is a view of the metallic shell as viewed in the direction of an arrow X1 in FIG. 3A.
Figure 4:
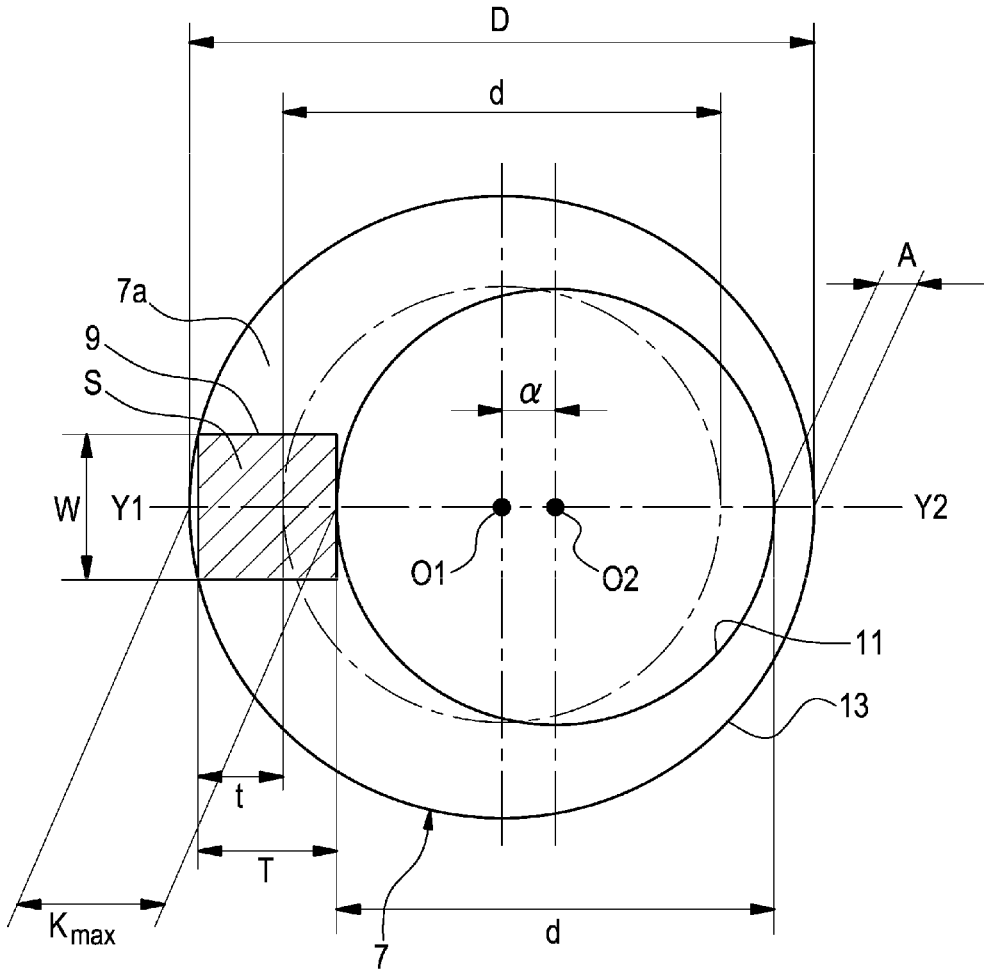
FIG. 4 is an enlarged view of the front end surface of the metallic shell shown in FIG. 1.

FIGS. 1 to 4 show a first embodiment of the spark plug according to the present invention. FIG. 1 is a vertical cross-sectional view of the first embodiment of the spark plug according to the present invention. FIG. 2 is an enlarged view of a main portion of FIG. 1. FIG. 3A is a side view of the metallic shell shown in FIG. 1, and FIG. 3B is a view of the metallic shell as viewed in the direction of an arrow X1 in FIG. 3A. FIG. 4 is an enlarged view of the front end surface of the metallic shell shown in FIG. 1.

As shown in FIGS. 1 and 2, a spark plug 1 of the first embodiment includes a rodlike center electrode 3 extending straight along a center axis O; a tubular insulator 5 disposed to surround the outer circumference of the center electrode 3; a tubular metallic shell 7 fitted onto the outer circumference of the insulator 5; and a ground electrode 9 whose one end 9*a* is welded to a front end surface 7*a* of the metallic shell 7 and whose other end 9*b* is disposed to face the distal end of the center electrode 3 to thereby form a spark discharge gap G between the ground electrode 9 and the center electrode 3.

In the present embodiment, the shapes of the inner and outer circumferential edges of the front end surface 7*a* of the metallic shell 7 are determined such that the thickness of the tubular wall of the metallic shell 7 in a certain region in the circumferential direction is greater than that in the remaining region.

More specifically, as shown in FIGS. 3A, 3B, and 4, in the case of the present embodiment, the inner circumferential edge 11 of the front end surface 7*a* is perfectly round and has a diameter d, and the outer circumferential edge 13 of the front end surface 7*a* is perfectly round and has a diameter D. However, as shown in FIG. 4, the center O2 of the inner circumferential edge 11 is shifted from the center O1 of the outer circumferential edge 13 by a distance α such that the metallic shell 7 has an increased wall thickness in a certain region.

In the case where the front end surface 7*a* has a shape defined by two perfectly round circles which are eccentric from each other, as shown in FIG. 4, the wall thickness of the metallic shell 7 measured on the front end surface 7*a* thereof becomes the minimum at one (the right-hand position in FIG. 4) of two opposite positions on a line Y1-Y2 (a line passing through the centers O1 and O2) extending in the direction of eccentricity, and becomes the maximum at the other (the left-hand position in FIG. 4) of the two opposite positions.

In the case of the present embodiment, the locally increased wall thickness measured on the front end surface 7*a* changes in accordance with the amount α of the eccentricity. In the case of the present embodiment, a portion of the region where the metallic shell 7 has an increased wall thickness is used as a region S in which the ground electrode 9 is welded to the front end surface 7*a*.

In the case of the present embodiment, the region S in which the ground electrode 9 is welded to the front end surface 7*a* is determined to satisfy the following two conditions:

$$K \geqq 1.1A \text{ and } K \geqq (D-d)/2,$$

where, as shown in FIG. 4, A represents the wall thickness of the metallic shell 7 measured on the front end surface 7*a* at a position where the wall thickness becomes the minimum; d represents the diameter of the inner circumferential edge 11 of the front end surface 7*a*; D represents the diameter of the outer circumferential edge 13 of the front end surface 7*a*; and K represents the wall thickness in a welding region of the front end surface 7*a*, which is a region where the ground electrode 9 is welded to the front end surface 7*a*.

In the case shown in FIG. 4, the region S where the ground electrode 9 is welded to the front end surface 7*a* includes a portion of the front end surface 7*a* in which the wall thickness becomes the maximum (Kmax).

The maximum wall thickness Kmax is represented by the following expression:

$$K\text{max} = \alpha + (D-d)/2.$$

In the case of the present embodiment, the ground electrode 9, which is to be welded to the front end surface 7*a* in the region S, has a transverse cross section of a simple rectangular shape, and has a width W and a thickness T determined such that the transverse cross section becomes smaller than the region S for welding the ground electrode 9. The thickness T is set to a possible largest value TKmax so long as the ground electrode 9 does not project from the region S.

Notably, a dimension t shown in FIG. 4 shows the wall thickness in the case where the inner circumferential edge 11 and the outer circumferential edge 13 are concentric with each other.

In the case of the present embodiment, the amount α of eccentricity between the inner and outer circumferential edges of the front end surface 7*a* is set to 0.5 mm or greater.

In the spark plug 1 of the above-described first embodiment, the shape of the front end surface 7*a* of the metallic shell 7 is determined such that the tubular wall of the metallic shell 7 has an increased thickness in a certain region in the circumferential direction, as compared with that in the remaining region.

Accordingly, as compared with a conventional metallic shell in which the inner and outer circumferential edges of the front end surface are concentric, perfectly round circles, and the outer and inner diameters of the front end surface are D and d, respectively, the wall thickness of the metallic shell 7 measured on the front end surface 7*a* thereof becomes non-uniform. Therefore, as shown in FIG. 4, a region where the metallic shell has an increased wall thickness as compared with the conventional metallic shell can be formed despite the area of the front end surface 7*a* being the same as that of the conventional metallic shell.

The spark plug 1 of the present embodiment satisfies the above-mentioned two conditions; i.e., $K \geqq 1.1A$ and $K \geqq (D-d)/2$, where A represents the wall thickness of the metallic shell 7 measured on the front end surface 7*a* at a position where the wall thickness becomes the minimum; d represents the diameter of the inner circumferential edge 11 of the front end surface 7*a*; D represents the diameter of the outer circumferential edge 13 of the front end surface 7*a*; and K represents the wall thickness in the region S of the front end surface 7*a*, in which the ground electrode 9 is welded to the front end surface 7*a*. Therefore, the thickness of the ground electrode 9 can be increased as compared with the case of the conventional metallic shell without fail.

Accordingly, as compared with the conventional metallic shell, the cross-sectional area of the ground electrode 9 can be increased by increasing the thickness of the ground electrode 9 without changing the area of the front end surface 7*a* of the metallic shell 7, whereby the breakage resistance of the ground electrode 9 can be enhanced.

Moreover, the wall thickness as measured in the region S of the front end surface 7*a* of the metallic shell 7 in which the ground electrode 9 is welded to the front end surface 7*a* is rendered greater than that of the conventional metallic shell. Therefore, it is possible to increase the thickness of the ground electrode 9, as compared with the conventional ground electrode, while maintaining the simple rectangular cross section of the ground electrode 9 as shown in FIG. 4, without imparting a curved shape to the ground electrode 9 such that the cross-sectional shape of the ground electrode 9 coincides with the curved shape of the front end surface 7*a* of the metallic shell 7.

Accordingly, the ground electrode 9 can be formed to have a simple rectangular cross section to thereby facilitate a bending work or the like performed for securing the spark discharge gap G.

Furthermore, in the spark plug 1 of the present embodiment, the maximum wall thickness can be adjusted by adjusting the amount $\alpha$ of the eccentricity between the outer and inner circumferential edges 13 and 11 of the front end surface 7*a*. When the amount $\alpha$ of the eccentricity is set to 0.5 mm or greater, the wall thickness becomes greater than $(D-d)/2$ in a circumferential region whose extent is equal to or greater than half the circumference of the front end surface 7*a* of the metallic shell 7. Thus, it becomes easy to secure the region S suitable for welding the ground electrode 9 having a sufficiently large thickness which remarkably enhances the breakage resistance thereof.

In order to demonstrate the effect of the above-described first embodiment, as shown in Table 1, the present inventors made 11 metallic shell samples having a conventional structure; i.e., having no eccentricity between the inner circumferential edge 11 and the outer circumferential edge 13; and 11 metallic shell samples each having an eccentricity within the range of the first embodiment.

Notably, as shown in Table 1, the metallic shell samples made with no eccentricity actually have a slight degree of eccentricity. The actual eccentricities of these metallic shell samples fall within the range of 0.09 mm to 0.19 mm, and their average is 0.14 mm. In the case of the metallic shell samples of the present embodiment having eccentricity, their actual eccentricities fall within the range of 1.80 mm to 2.30 mm, and their average is 1.87 mm.

TABLE 1

| | Eccentricity (mm) | |
|---|---|---|
| | No eccentricity | Eccentricity is provided |
| Sample 1 | 0.18 | 1.84 |
| Sample 2 | 0.11 | 1.92 |
| Sample 3 | 0.13 | 2.01 |
| Sample 4 | 0.15 | 2.20 |
| Sample 5 | 0.19 | 2.06 |
| Sample 6 | 0.09 | 2.07 |
| Sample 7 | 0.11 | 1.93 |
| Sample 8 | 0.14 | 1.80 |
| Sample 9 | 0.15 | 2.30 |
| Sample 10 | 0.13 | 1.99 |
| Sample 11 | 0.14 | 0.50 |
| Average | 0.14 | 1.87 |

Subsequently, a breakage resistance test was performed for each of the metallic shell samples shown in Table 1. Specifically, as shown in Table 2 below, previously prepared five types of ground electrodes having different thicknesses were welded in turn to each of the metallic shell samples, and the breakage resistance of each ground electrode was determined.

As shown in Table 2 below, the five types of ground electrodes have thicknesses of 1.3 mm, 1.8 mm, 2.3 mm, 2.8 mm, and 3.3 mm, respectively.

Figure 5:
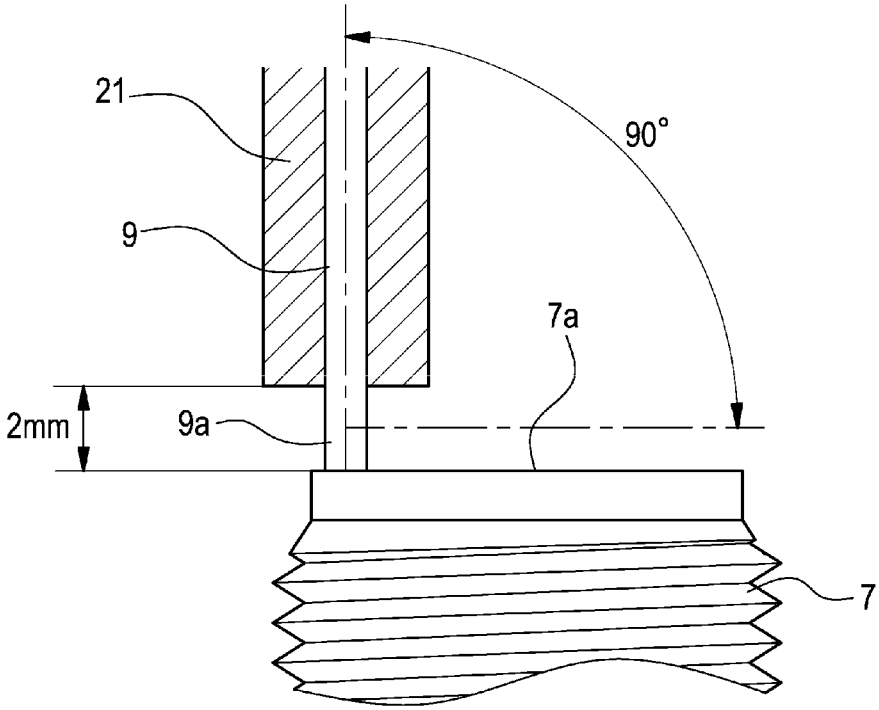
FIG. 5 Explanatory view showing a method of inspecting the breakage resistance of the ground electrode welded to the front end surface of the metallic shell.

FIG. 5 shows the method of determining the breakage resistance. As shown in FIG. 5, one end 9*a* of the ground electrode 9 is welded to the front end surface 7*a* of the sample metallic shell 7. The ground electrode 9 welded to the front end surface 7*a* in a standing state is bent 90 degrees through use of a bending jig 21 at a position 2 mm away from the front end surface 7*a*, and is returned to the original standing state. This operation is repeated.

Table 2 below summarizes the results of measurement in the above-described bending test. In this test, for each of the samples shown in Table 1, the number of times of bending before breakage was measured for each of the above-mentioned five types of the ground electrodes.

The number of times of bending before breakage is determined by counting the number of times the bending work is repeated until the ground electrode 9 welded to the metallic shell samples breaks. Every time the ground electrode 9 is returned to the original standing position after being bent by 90 degrees, the counted number of times increases by one.

TABLE 2

| | Number of times of bending before breaking (times) | | | | | | | | | |
|---|---|---|---|---|---|---|---|---|---|---|
| | No eccentricity is provided | | | | | Eccentricity is provided | | | | |
| | Thickness of outer electrode | | | | | | | | | |
| | 1.3 | 1.8 | 2.3 | 2.8 | 3.3 | 1.3 | 1.8 | 2.3 | 2.8 | 3.3 |
| Sample 1 | 5.0 | 5.0 | 5.0 | 3.0 | 1.0 | 5.0 | 5.0 | 5.0 | 5.0 | 3.0 |
| Sample 2 | 5.0 | 5.0 | 4.0 | 2.0 | 1.0 | 5.0 | 5.0 | 4.0 | 4.0 | 5.0 |
| Sample 3 | 5.0 | 4.0 | 4.0 | 2.0 | 2.0 | 5.0 | 5.0 | 5.0 | 4.0 | 3.0 |
| Sample 4 | 5.0 | 5.0 | 3.0 | 2.0 | 0.5 | 5.0 | 5.0 | 5.0 | 5.0 | 4.0 |
| Sample 5 | 5.0 | 5.0 | 4.0 | 2.5 | 1.5 | 5.0 | 4.0 | 4.0 | 5.0 | 4.5 |

TABLE 2-continued

| | Number of times of bending before breaking (times) | | | | | | | | | |
|---|---|---|---|---|---|---|---|---|---|---|
| | No eccentricity is provided | | | | | Eccentricity is provided | | | | |
| | Thickness of outer electrode | | | | | | | | | |
| | 1.3 | 1.8 | 2.3 | 2.8 | 3.3 | 1.3 | 1.8 | 2.3 | 2.8 | 3.3 |
| Sample 6 | 5.0 | 5.0 | 3.0 | 3.0 | 1.0 | 5.0 | 4.0 | 5.0 | 5.0 | 3.5 |
| Sample 7 | 5.0 | 4.0 | 4.0 | 2.0 | 1.0 | 5.0 | 4.0 | 4.0 | 4.0 | 4.0 |
| Sample 8 | 5.0 | 5.0 | 5.0 | 2.5 | 0.5 | 5.0 | 5.0 | 5.0 | 4.0 | 3.0 |
| Sample 9 | 5.0 | 5.0 | 4.0 | 2.5 | 1.5 | 5.0 | 4.0 | 4.0 | 5.0 | 4.5 |
| Sample 10 | 5.0 | 4.0 | 3.0 | 3.0 | 1.5 | 5.0 | 5.0 | 5.0 | 4.0 | 5.0 |
| Sample 11 | 5.0 | 5.0 | 4.0 | 3.0 | 1.5 | 5.0 | 4.0 | 4.0 | 4.0 | 3.0 |
| Average | 5.0 | 4.7 | 3.9 | 2.5 | 1.2 | 5.0 | 4.5 | 4.5 | 4.5 | 3.9 |
| Evaluation | AA | AA | BB | XX | XX | AA | AA | AA | AA | BB |

Evaluation criteria
AA: 4 times or greater
BB: 3 to 3.5 times
XX: 2.5 times or less At the time of measurement, the breakage resistance of each ground electrode was evaluated excellent (AA), good (BB), or unacceptable (XX) in accordance with the number of times of bending before breakage. A ground electrode whose number of times of bending before breakage was 4 times or greater was evaluated excellent (AA). A ground electrode whose number of times of bending before breakage was 3 to 3.5 times or greater was evaluated good (BB). A ground electrode whose number of times of bending before breakage was 2.5 times or less was evaluated unacceptable (XX).

In the case of the metallic shells having the conventional structure in which the center of the inner circumferential edge of the front end surface is not eccentric in relation to the center of the outer circumferential edge thereof, the breakage resistance was evaluated unacceptable for two types of ground electrodes having a large thickness (2.8 mm, 3.3 mm). This is because the thickness of the ground electrode was greater than the wall thickness of the metallic shell measured on the front end surface, and the ground electrode was welded in a state in which a portion of the ground electrode in the thickness direction thereof projected from the front end surface, which resulted in a failure to obtain sufficient welding strength.

Meanwhile, in the case of the metallic shells of the present embodiment configured such that the center of the inner circumferential edge of the front end surface is eccentric in relation to the center of the outer circumferential edge thereof, the breakage resistance was evaluated good even for the case where the ground electrode having the maximum thickness (3.3 mm) was welded. In the remaining cases where the ground electrodes having thicknesses smaller than that thickness were used, the breakage resistance was evaluated excellent, from which it was confirmed that the breakage resistance is clearly enhanced as compared with the case where no eccentricity is present between the outer and inner circumferential edges of the front end surface.

Figure 6:
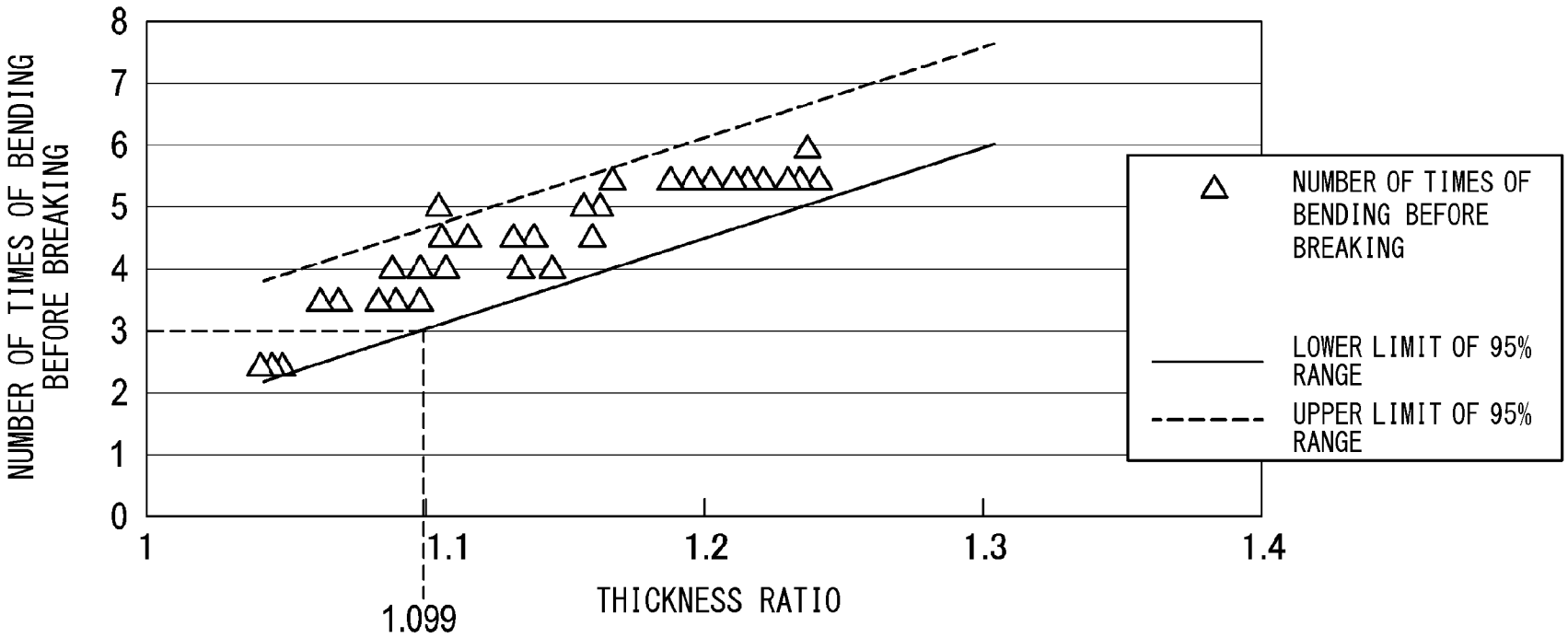
FIG. 6 is a graph showing the results of a test performed in order to confirm the action and effect of the first embodiment, in which ground electrodes having different thicknesses were welded to a plurality of metallic shells having different eccentricities between the inner and outer circumferential edges of the front end surface, and breakage strength was measured, the graph showing the correction between the wall thickness ratio and the number of times of bending before breakage.

The graph of FIG. 6 shows the results of the measurement performed in the above-described bending test; i.e., the correlation between the number of times of bending before breakage and the thickness ratio.

In the graph of FIG. 6, the vertical axis represents the number of times of bending before breakage, and the horizontal axis represents the wall thickness ratio. The graph shows the correlation between the number of times of bending before breakage of each sample and the wall thickness ratio of each sample. Two straight lines in the graph show the upper and lower limit of a 95% range in which 95% of the samples fall.

The number of times of bending before breakage has the above-described definition.

The wall thickness ratio is a value obtained by dividing the wall thickness K in the region S of the front end surface 7*a* where the ground electrode 9 is welded to the front end surface 7*a*, by the minimum wall thickness A on the front end surface 7*a*.

As shown in FIG. 6 as well, a linear relation exists between the wall thickness ratio and the number of times of bending before breakage. The lower limit value of the wall thickness ratio above which the number of times of bending before breakage becomes 3 times or greater was 1.099. In the first embodiment of the present invention, the wall thickness ratio is set to 1.1 or greater. Therefore, in the case of the samples of the present embodiment, the number of times of bending before breakage becomes 3 or greater, from which it was confirmed that the breakage resistance is enhanced.

The specific shape of the front end portion of the metallic shell according to the present invention is not limited to that shown in the first embodiment. The front end portion of the metallic shell may have any one of the shapes shown in FIGS. 7A to 10.

Figure 7A:
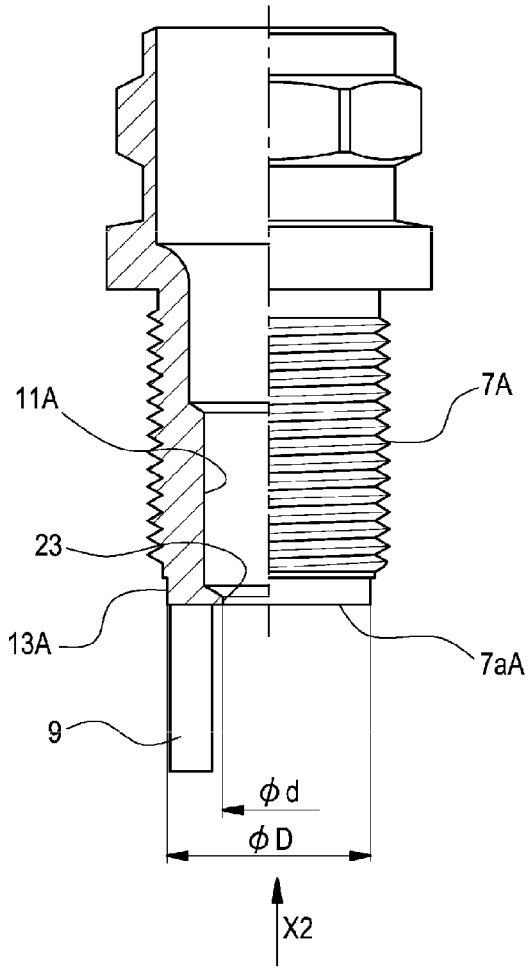
FIG. 7A is a side view of a metallic shell employed in a second embodiment of the spark plug according to the present invention.
Figure 7B:
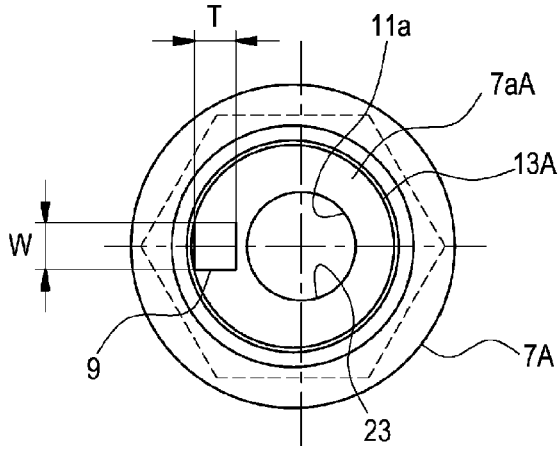
FIG. 7B is a view of the metallic shell as viewed in the direction of an arrow X2 in FIG. 7A.

FIG. 7A is a side view of a metallic shell employed in a second embodiment of the spark plug according to the present invention, and FIG. 7B is a view of the metallic shell as viewed in the direction of an arrow X2 in FIG. 7A.

The metallic shell 7A of the second embodiment is obtained from the metallic shell 7 of the first embodiment through partial improvement thereof. The front end surface 7*a*A of the improved metallic shell 7A has a projection 23 integrally formed such that the projection 23 projects radially inward from the inner circumferential edge 11A in order to increase the wall thickness measured on the front end surface 7*a*A, to thereby facilitate the welding of the ground electrode 9.

As viewed on the front end surface 7*a*A, the center of the inner circumferential edge 11*a* of the projection 23 is eccentric in relation to the center of the outer circumferential edge 13A.

Figure 8A:
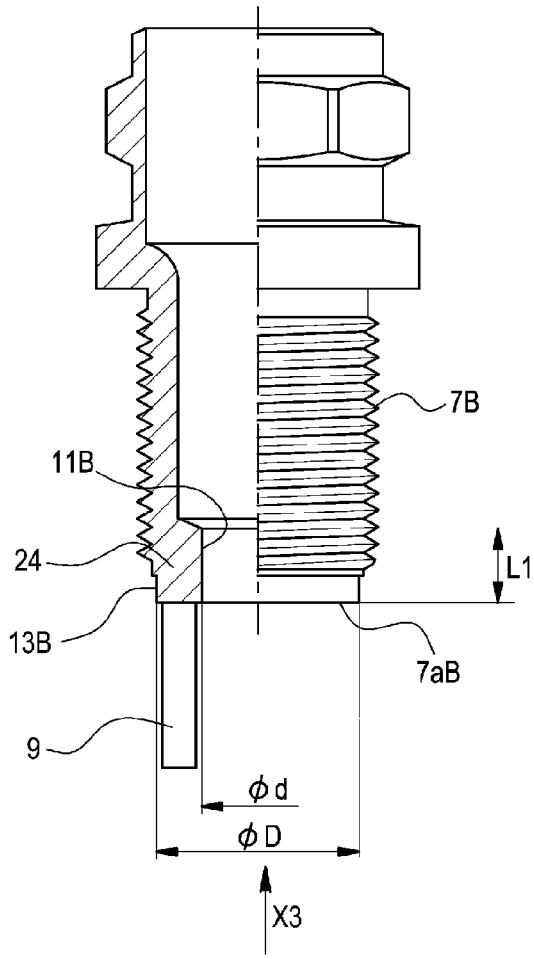
FIG. 8A is a side view of a metallic shell employed in a third embodiment of the spark plug according to the present invention.
Figure 8B:
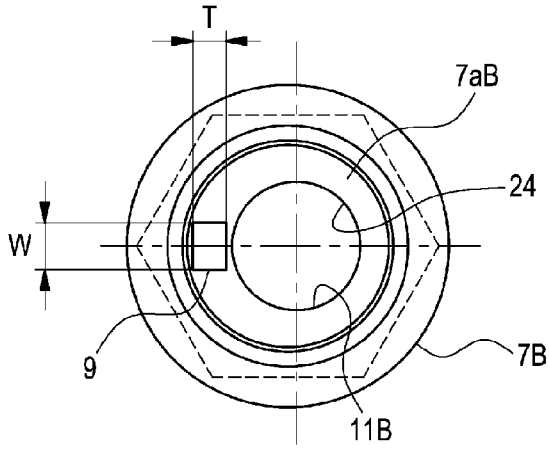
FIG. 8B is a view of the metallic shell as viewed in the direction of an arrow X3 in FIG. 8A.

FIG. 8A is a side view of a metallic shell employed in a third embodiment of the spark plug according to the present invention, and FIG. 8B is a view of the metallic shell as viewed in the direction of an arrow X3 in FIG. 8A.

The metallic shell 7B of the third embodiment is obtained from the metallic shell 7 of the first embodiment through partial improvement thereof. The improved metallic shell 7B has a thick wall portion 24 having an increased wall thickness, as compared with that on the proximal end side, in a range on the side toward the front end surface 7*a*B, the range having a length L1 as measured in the axial direction. Thus, the welding of the ground electrode 9 is facilitated.

As viewed on the front end surface 7*a*B, the center of the inner circumferential edge 11B of the thick wall portion 24 is eccentric in relation to the center of the outer circumferential edge 13B.

Figure 9:
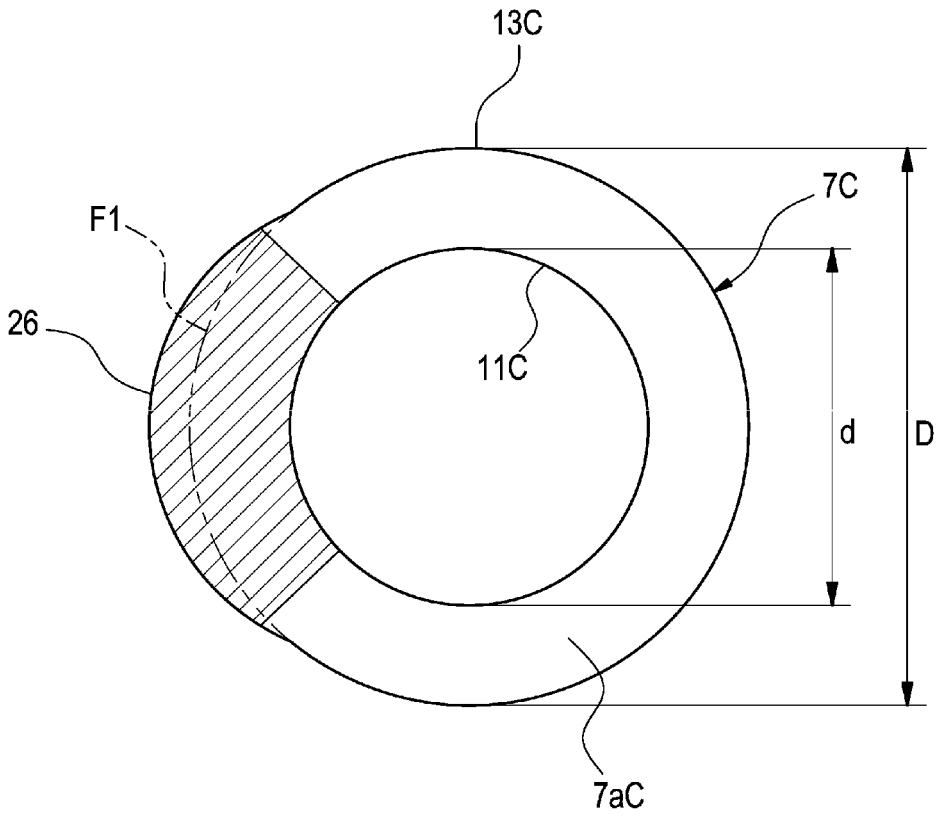
FIG. 9 is an explanatory view showing the shape of the front end surface of the metallic shell in a fourth embodiment of the spark plug according to the present invention.

FIG. 9 is an explanatory view showing the shape of the front end surface of the metallic shell in a fourth embodiment of the spark plug according to the present invention.

In the case of the metallic shell 7C of the fourth embodiment, the outer circumferential edge 13C is not a perfectly round circle, and has a distorted shape in a certain region extending in the circumferential direction. That is, the outer circumferential edge 13C has a bulging portion 26 which budges outward from an imaginary line F1 representing the perfectly round circle.

The bulging portion 26 forms a region which extends in the circumferential direction and in which the metallic shell has an increased wall thickness as compared with that in the remaining region.

As described above, on the front end surface of the metallic shell according to the present invention, a region in which the metallic shell has an increased wall thickness may be secured by forming the bulging portion of the outer circumferential edge, rather than providing eccentricity between the inner and outer circumferential edges which are perfectly round circles.

In the case where the outer circumferential edge 13C of the front end surface 7*a*C is not a perfectly round circle as shown in FIG. 9, the region in which the ground electrode is welded to the front end surface 7*a*C is set as follows.

That is, a region (indicated by hatching) in which the ground electrode 9 is welded to the front end surface 7*a*C is set such that the following two conditions are satisfied:

$$K \geqq 1.1A \text{ and } K \geqq (D-d)/2,$$

where A represents the wall thickness in the radial direction measured on the front end surface 7*a*C at a position where the wall thickness becomes the minimum; d represents the maximum inner diameter of the front end surface 7*a*C; D represents the minimum outer diameter of the front end surface 7*a*C; and K represents the wall thickness in the region of the front end surface 7*a*C where the ground electrode 9 is welded to the front end surface 7*a*C.

Figure 10:
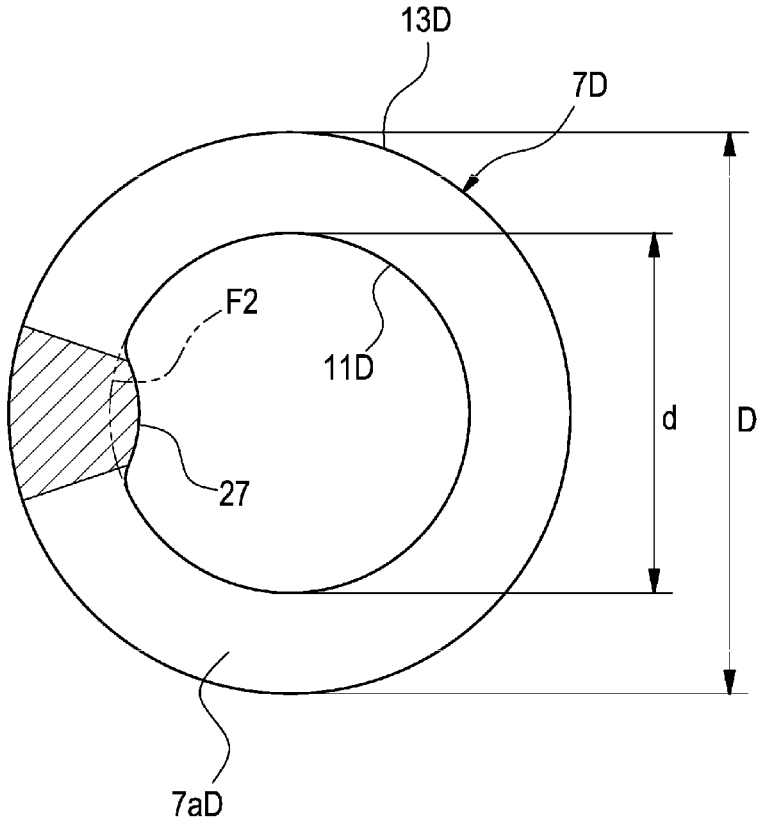
FIG. 10 is an explanatory view showing the shape of the front end surface of the metallic shell in a fifth embodiment of the spark plug according to the present invention.

FIG. 10 is an explanatory view showing the shape of the front end surface of the metallic shell in a fifth embodiment of the spark plug according to the present invention.

In the case of the metallic shell 7D of the fifth embodiment, the inner circumferential edge 11C is not a perfectly round circle, and has a distorted shape in a certain region extending in the circumferential direction. That is, the inner circumferential edge 11C has a bulging portion 27 which budges inward from an imaginary line F2 representing the perfectly round circle.

The bulging portion 27 forms a region which extends in the circumferential direction and in which the metallic shell has an increased wall thickness as compared with that in the remaining region.

As described above, on the front end surface of the metallic shell according to the present invention, a region to which the ground electrode is welded may be secured by forming the bulging portion of the inner circumferential edge, rather than providing eccentricity between the inner and outer circumferential edges which are perfectly round circles.

In the case where the inner circumferential edge 11C of the front end surface 7*a*D is not a perfectly round circle as shown in FIG. 10, the region in which the ground electrode is welded to the front end surface 7*a*D is set as follows.

That is, a region (indicated by hatching) in which the ground electrode 9 is welded to the front end surface 7*a*D is set such that the following two conditions are satisfied:

$$K \geqq 1.1A \text{ and } K \geqq (D-d)/2,$$

where A represents the wall thickness measured on the front end surface 7*a*D at a position where the wall thickness becomes the minimum; d represents the maximum inner diameter of the front end surface 7*a*D; D represents the minimum outer diameter of the front end surface 7*a*D; and K represents the wall thickness in the region of the front end surface 7*a*D where the ground electrode 9 is welded to the front end surface 7*a*D.

In the cases of the above-described second to fifth embodiments as well, like the case of the first embodiment, it is possible to enhance the breakage resistance of the ground electrode by increasing the cross-sectional area of the ground electrode, without changing the area of the front end surface of the metallic shell.

Notably, the spark plug of the present invention is not limited to the above-described embodiments, and may be modified or improved as needed.

In the first embodiment, the region S where the ground electrode is welded to the front end surface of the metallic shell is set to a location where the wall thickness becomes the maximum. However, the position of the region S where the ground electrode is welded is not limited to that employed in the above-described embodiments, and the region S may be provided in any location so long as the above-mentioned two conditions ($K \geqq 1.1A$, and $K \geqq (D-d)/2$) are satisfied.

[Description of Reference Numerals]

| | |
|---|---|
| 1: | spark plug |
| 3: | center electrode |
| 5: | insulator |
| 7, 7A, 7B, 7C, 7D: | metallic shell |
| 7a, 7aA, 7aB, 7aC, 7aD: | front end surface |
| 9: | ground electrode |
| 11, 11A, 11B, 11C, 11D: | inner circumferential edge |
| 13, 13A, 13B, 13C, 13D: | outer circumferential edge |
| a: | amount of eccentricity |

The invention claimed is:

1. A spark plug including a tubular metallic shell, and a ground electrode welded to a front end surface of the metallic shell, the spark plug being characterized by satisfying the following relations (1) and (2):

$$K \geqq 1.1A \quad (1)$$

$$K \geqq (D-d)/2 \quad (2)$$

where A represents a wall thickness of the metallic shell in the radial direction measured on the front end surface at a position where the wall thickness becomes the minimum; d represents a maximum inner diameter of the front end surface; D represents a minimum outer diameter of the front end surface; and K represents the wall thickness in a region of the front end surface where the ground electrode is welded to the front end surface.

2. A spark plug according to claim 1, wherein the front end surface has a circular outer circumferential edge and a circular inner circumferential edge, and an eccentricity of 0.5 mm or greater is present between the center of the outer circumferential edge and the center of the inner circumferential edge.

* * * * *